US006888426B2

(12) United States Patent
Hidaka et al.

(10) Patent No.: US 6,888,426 B2
(45) Date of Patent: May 3, 2005

(54) RESONATOR, FILTER, DUPLEXER, AND HIGH-FREQUENCY CIRCUIT APPARATUS

(75) Inventors: Seiji Hidaka, Nagaokakyo (JP); Yasuo Fujii, Yokohama (JP); Shin Abe, Muko (JP)

(73) Assignee: Murata Manufacturing Co. Ltd (JP)

( * ) Notice: Subject to any disclaimer, the term of this patent is extended or adjusted under 35 U.S.C. 154(b) by 131 days.

(21) Appl. No.: 10/255,962

(22) Filed: Sep. 27, 2002

(65) Prior Publication Data

US 2003/0062974 A1 Apr. 3, 2003

(30) Foreign Application Priority Data

Sep. 27, 2001 (JP) ..... 2001-297958
Aug. 19, 2002 (JP) ..... 2002-238451

(51) Int. Cl.[7] ..... H01P 7/04
(52) U.S. Cl. ..... 333/222; 333/219; 333/204
(58) Field of Search ..... 333/222, 115, 333/204, 219, 238, 243, 206, 219.1, 242

(56) References Cited

U.S. PATENT DOCUMENTS 5,408,053 A * 4/1995 Young ..... 174/264
5,804,919 A * 9/1998 Jacobsen et al. ..... 313/506
6,148,221 A * 11/2000 Ishikawa et al. ..... 505/210
6,556,101 B1 4/2003 Tada et al.

FOREIGN PATENT DOCUMENTS

CN 1301055 A 6/2001

* cited by examiner

*Primary Examiner*—Brian Young
*Assistant Examiner*—John B Nguyen
(74) *Attorney, Agent, or Firm*—Dickstein, Shapiro, Morin & Oshinsky, LLP.

(57) ABSTRACT

In a resonator having a dielectric member and an electrode formed on the dielectric member, a displacement area (D area) having a high vertical electric field component, and a short or steady area (S area) having a vertical electric field component of zero or close to zero are provided in an interface between the dielectric member and the electrode. A single-layer conductive film divided into portions is formed in the D area or on the side surfaces of the dielectric member, and a multilayer thin-film electrode is formed in the S area or on the end faces of the dielectric member. Conductive thin films of the multilayer thin-film electrode are alternately connected to the single-layer conductive film portions. In-phase currents having the same amplitude flow to the conductive thin films of the multilayer thin-film electrode in the S area in radial direction with respect to the axis of symmetry, thus achieving low-loss operation of the multilayer thin-film electrode in the S area.

18 Claims, 14 Drawing Sheets

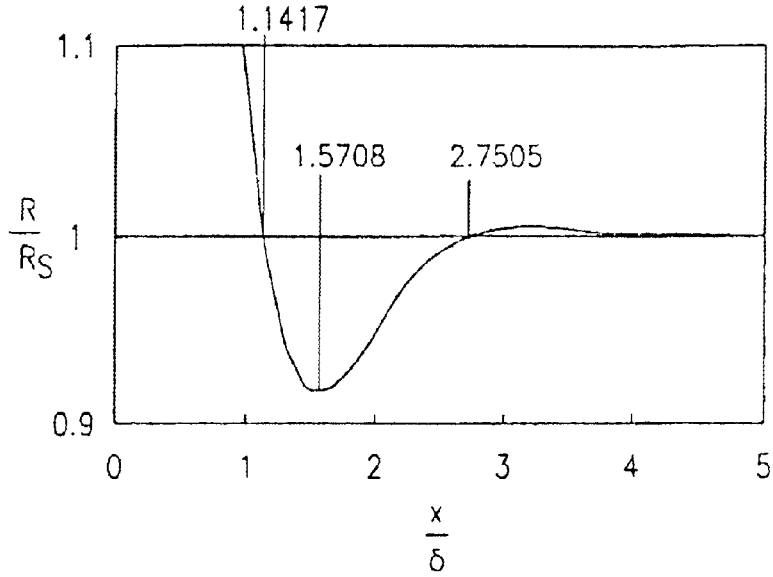
FIG. 15
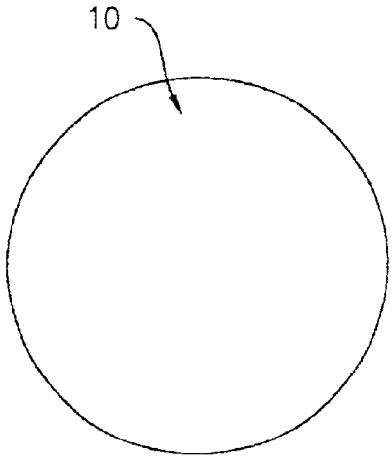
(PRIOR ART)
FIG. 16A
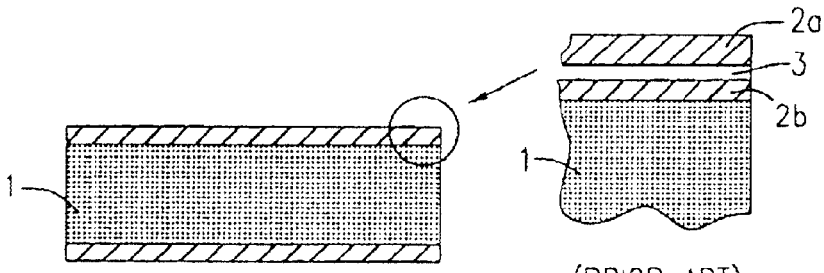
(PRIOR ART)
FIG. 16B
(PRIOR ART)
FIG. 16C

RESONATOR, FILTER, DUPLEXER, AND HIGH-FREQUENCY CIRCUIT APPARATUS

BACKGROUND OF THE INVENTION

1. Field of the Invention

The present invention relates to a resonator, filter, duplexer, and high-frequency circuit apparatus used in the microwave or millimeter wave band for use in radio communication or in electromagnetic-wave transmission/reception.

2. Description of the Related Art

In the related art, U.S. Pat. No. 6,148,221 (the '221 patent) discloses a resonator incorporating a multilayer thin-film electrode.

The multilayer thin-film electrode disclosed in the '221 patent is formed by alternately layering conductive thin films and dielectric thin films, and serves as an electrode which provides low loss in a high-frequency region. In a design method disclosed in the publication, the optimum thicknesses of the conductive thin films and the dielectric thin films depend upon the conductivity and the dielectric constant, respectively. Optimizing the thicknesses of the conductive thin films and the dielectric thin films allows the current density to be uniformly distributed over the layered conductive thin films, thereby mitigating the skin effect. The multilayer electrode can therefore be operated with lower loss than a single-layer electrode.

In the resonator disclosed in the '221 patent which incorporates a multilayer thin-film electrode, the dielectric constant and thickness of the dielectric thin films are adapted to control a displacement current between the conductive thin films in order to distribute a current substantially uniformly over the conductive thin films of the multilayer thin-film electrode. Thus, the following two requirements are essential for low-loss operation of the multilayer thin-film electrode:

(1) that the multilayer thin-film electrode be orthogonal to the orientation of electric field vector; and
(2) that the dielectric constant and thickness of the dielectric thin films be designed to be optimum or close to optimum.

In the resonator disclosed in the '221 patent, therefore, a single-layer electrode is used for an electrode tangential to the orientation of electric field vector, and ends of each of the thin conductive layers of the multilayer thin-film electrode formed on the surface orthogonal to the orientation of the electric field vector are short-circuited by the single-layer electrode. Otherwise, the surface tangential to the orientation of the electric field vector is open, and no electrode is formed on that surface.

FIGS. 16A and 16B are a top plan view and a front view, respectively, of an open-circuited circular TM010-mode resonator in the related art. FIG. 16C is a cross-sectional view showing an enlarged part of the resonator shown in FIG. 16B. In FIGS. 16A to 16C, a multilayer thin-film electrode 10 having a two-layer construction in which a dielectric thin film 3 is sandwiched between conductive thin films 2*a* and 2*b* is formed on each of two parallel surfaces of a cylindrical dielectric member 1.

FIGS. 17A and 17B are a top plan view and a front view, respectively, of a short-circuited circular TM010-mode resonator. FIG. 17C is a cross-sectional view showing an enlarged part of the resonator shown in FIG. 17B. In FIGS. 17A to 17C, the peripheries of conductive thin films 2*a* and 2*b* are connected to a single-layer conductive film 4 so that the peripheries of the conductive thin films 2*a* and 2*b* may be short-circuited.

SUMMARY OF THE INVENTION

Accordingly, it is an object of the present invention to provide a resonator, filter, duplexer, and high-frequency circuit apparatus having an electrode formed in a region where the vertical electric field component is zero or close to zero, whereby the conductor loss of that electrode can be reduced, thus achieving low-loss operation.

In an aspect of the present invention, a resonator includes a dielectric member and an electrode formed on the dielectric member. In such a dielectric resonator, a displacement area (D area) in which an electric field has a higher vertical component than a predetermined threshold, and a short or steady area (S area) in which an electric field has a lower vertical component than the threshold are provided in an interface between the dielectric member and the electrode. The electrode in the S area comprises a multilayer thin-film electrode formed by alternately layering conductive thin films and a dielectric thin film. Over the conductive thin films, currents having substantially equal amplitude are forcibly excited. The predetermined threshold is close to zero, and is, for example, about 5% of the maximum electric field strength in a resonant mode used.

In the multilayer thin-film electrode in the S area, the dielectric thin film is sandwiched between the upper and lower conductive thin films, thereby forming a multilayer thin-film electrode resonator.

In the multilayer thin-film electrode resonator, if the electrical angle for 5% of the maximum electric field strength is indicated by θ1, then, sin θ1=0.05. That is, the electrical angle θ1 is approximately 2.87°.

Integration of displacement currents is expressed by the following equations:

$$I_d = \int_0^{\pi/2} \sin\theta d\theta = ([-\cos\theta])_0^{\pi/2} = 1 \tag{1}$$

$$I_{d1} = \int_0^{\theta 1} \sin\theta d\theta = [-\cos\theta]_0^{\theta 1} = 1 - \cos\theta 1 \tag{2}$$

Substituting θ1 having a value of approximately 2.87° into Equation (2), then, $I_{d1}$ is approximately 0.00125 (0.125%). Specifically, in a range of the above-noted threshold of 5% of the maximum electric field strength or lower, in the S area, the ratio by which an actual current is transformed into a displacement current is 0.125% or lower. Therefore, if the distribution of the actual current which is substantially uniformly distributed over the S area is deviated from the sine wave distribution expressed by Equations (1) and (2), the above ratio is within about 0.125%. Thus, if an actual current is transformed into a displacement current by a small ratio, condition that the multilayer thin-film electrode is operated with low loss can be successfully reserved. Therefore, a boundary of the S and D areas should be defined using, as a threshold, about 5% of the maximum electric field strength in a resonant mode used.

A current source in a passive circuit can be regarded as a boundary condition. This means that the current source is connected to a conductor in another passive circuit. For example, in a passive circuit in a multi-conductor mechanism having a high symmetrical structure and having an electromagnetic mode that is highly symmetrical, currents are uniformly distributed over the conductors.

According to the present invention, such conductors are connected to the conductive thin films of the multilayer thin-film electrode in the S area in a symmetrical fashion with the conductors, thus achieving forced excitation with uniform current amplitude.

In a specific form, the electrode in the S area may comprise a multilayer thin-film electrode formed by alternately layering conductive thin films and a dielectric thin film, and the electrode in the D area may comprise a multilayer thin-film electrode having the same number of layered films as the number of layered films of the multilayer thin-film electrode in the S area, such that the corresponding conductive thin films of the multilayer thin-film electrodes in the S area and the D area are electrically connected to each other.

This structure allows a current in the conductive thin films in the D area to be distributed over the conductive thin films of the multilayer thin-film electrode in the S area, thereby causing a current to substantially uniformly flow to the entire part. As a result, the conductor loss of the multilayer thin-film electrode in the S area can be reduced.

In another specific form, the electrode in the S area may comprise a multilayer thin-film electrode formed by alternately layering conductive thin films and a dielectric thin film, and the electrode in the D area may comprise an electrode which is divided into substantially congruent electrode patterns of an integer multiple of the number of conductive thin films of the multilayer thin-film electrode in the S area, such that the electrode patterns and the conductive thin films of the multilayer thin-film electrode in the S area are connected to each other correspondingly.

This structure allows a current in the separated electrode patterns in the D area to be distributed over the conductive thin films of the multilayer thin-film electrode in the S area, thereby causing a current to substantially uniformly flow to the entire part. As a result, the conductor loss of the multilayer thin-film electrode in the S area can be reduced.

The resonator according to the present invention may use a dielectric member having one or a plurality of curves and a plurality of flat surfaces, or a dielectric member having a plurality of flat surfaces, in which the D area and the S area are defined in each of the surfaces of the dielectric member.

This makes it easy to form a multilayer thin-film electrode on each surface of the dielectric member or to form a plurality of separated electrode patterns.

In the resonator according to the present invention, preferably, the thickness of at least one of the conductive thin films is 2.75 times the skin depth or lower. Thus, the ratio of the conductive thin films to a bulk conductor in surface resistance can be small, thereby increasing an effect of reducing the conductor loss involved with a multilayer thin-film structure.

In another aspect of the present invention, a filter according to the present invention includes a resonator having the above-described structure, and signal input/output units. Therefore, a compact filter having low insertion loss can be achieved.

In still another aspect of the present invention, a duplexer according to the present invention includes two filters having the above-described structure. The signal input/output units include a transmission-signal input terminal, a shared transmission and reception input and output terminal, and a received-signal output terminal. Therefore, a compact duplexer having low insertion loss can be achieved.

In still another aspect of the present invention, a high-frequency circuit apparatus according to the present invention includes the above-described resonator, filter, or duplexer. Therefore, a compact and low-loss high-frequency circuit can be achieved. A communication apparatus incorporating such a high-frequency circuit can improve the communication quality such as a noise characteristic and the transmission speed.

BRIEF DESCRIPTION OF THE DRAWINGS

FIG. 15 is a graph showing the relationship between the conductive film thickness and the normalized surface resistance;

FIGS. 16A to 16C are views of a resonator in the related art; and

DESCRIPTION OF THE PREFERRED EMBODIMENTS

A resonator according to a first embodiment of the present invention is now described with reference to FIGS. 1A to 3C and FIGS. 11A to 15.

Figure 1A:
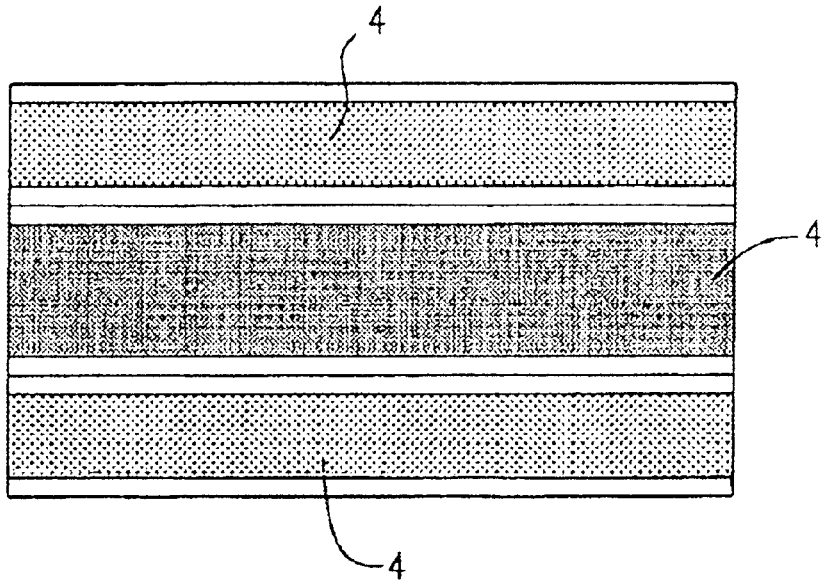
FIGS. 1A and 1B are views of a resonator according to a first embodiment of the present invention.
Figure 1B:
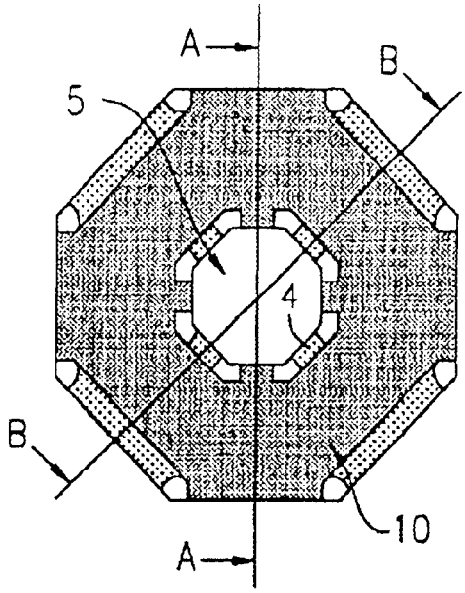

FIGS. 1A and 1B are a front view and a right side view, respectively, of the resonator of the present invention. FIGS.

Figure 2A:
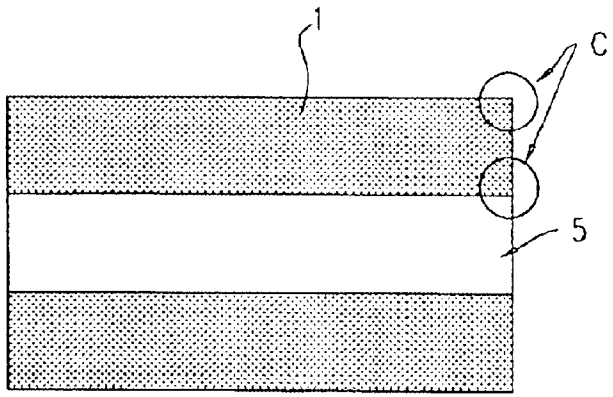
FIGS. 2A and 2B are cross-sectional views of the resonator, taken along lines A—A and B—B of FIGS. 1A and 1B, respectively.
Figure 2B:
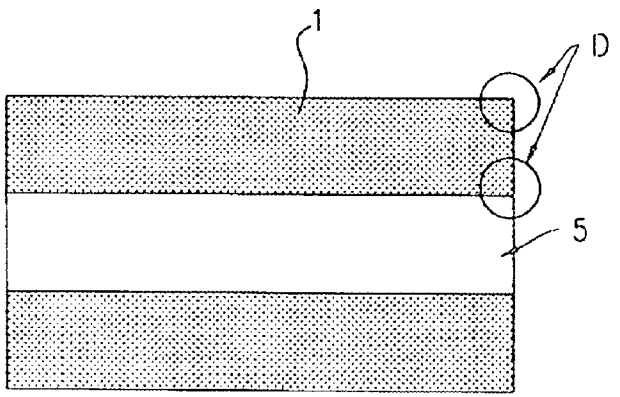
Figure 2C:
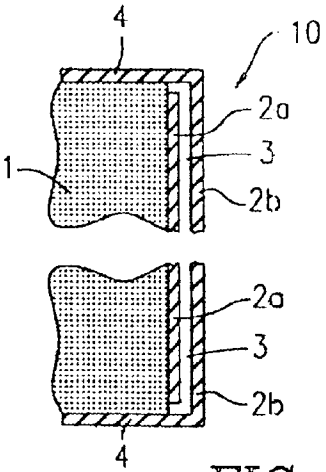
FIGS. 2C and 2D are cross-sectional views of the enlarged version of part C and D of the resonator shown in FIGS. 2A and 2B, respectively.
Figure 2D:
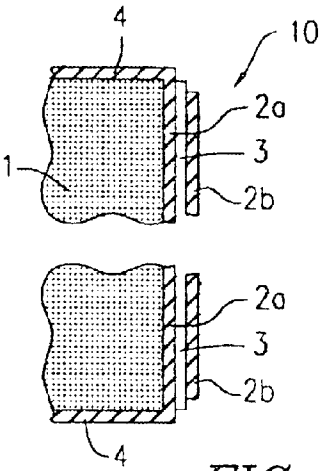

2A and 2B are cross-sectional views of the resonator, taken along lines A—A and B—B of FIG. 1B, respectively. FIGS. 2C and 2D are cross-sectional views of the enlarged version of part C and D of the resonator shown in FIGS. 2A and 2B, respectively.

The resonator is formed of a dielectric member 1 and predetermined electrodes formed on the dielectric member 1. The dielectric member 1 preferably has an octagonal tubular shape in which a hole 5, which is preferably octagonal in cross section, is formed in the center. A single-layer conductive film 4 is formed on each of the eight side surfaces of the dielectric member 1 so as to be separated at ridges of the eight side surfaces. The single-layer conductive film 4 is also formed on each of the eight inner surfaces of the hole 5 so as to be separated at corners of the eight surfaces. A multilayer thin-film electrode 10 is formed on each of the two parallel end faces of the dielectric member 1.

Figure 3A:
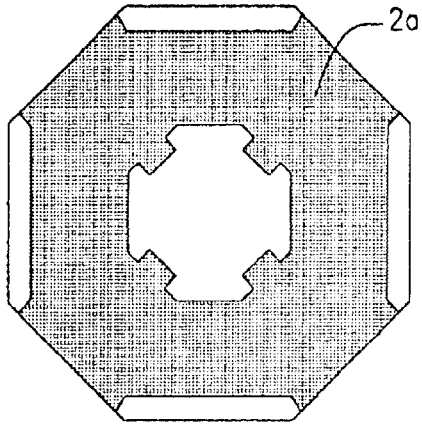
FIGS. 3A to 3C are views showing the configuration of film layers of a multilayer thin-film electrode in an S area of the resonator.
Figure 3B:
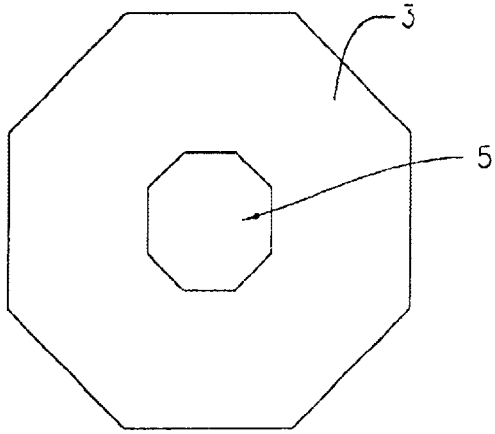
Figure 3C:
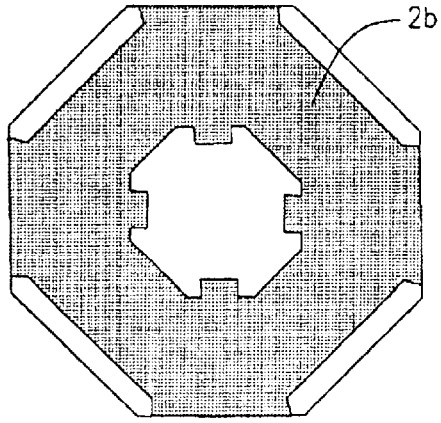

FIGS. 3A to 3C show the configuration of film layers of the multilayer thin-film electrode 10. FIG. 3A shows a pattern of a first conductive thin film 2*a* formed on a surface of the dielectric member 1; FIG. 3B shows a pattern of a dielectric thin film 3 which overlies the first conductive thin film 2*a*; and FIG. 3C shows a pattern of a second conductive thin film 2*b* which overlies the dielectric thin film 3. As shown in FIGS. 3A to 3C and FIGS. 2C and 2D, the first conductive thin film 2*a* is electrically connected to four outer surfaces of the dielectric member 1 and four inner surfaces of the hole 5. Also, the second conductive thin film 2*b* is electrically connected to four outer surfaces of the dielectric member 1 and four inner surfaces of the hole 5. It is noted that the first conductive thin film 2*a* and the second conductive thin film 2*b* are electrically connected to the single-layer conductive film 4 in an alternate manner, so that the first and second conductive thin films 2*a* and 2*b* are electrically isolated from each other.

The resonator according to the first embodiment is a coaxial resonator which is resonated in a TEM mode in which the electric field vector is oriented between the single-layer conductive film 4 formed on the inner surfaces of the hole 5 and the single-layer conductive film 4 formed on the outer surfaces of the dielectric member 1. A resonator provided with the multilayer thin-film electrode 10 on each of the two parallel end faces of the dielectric member 1 would serve as a short-ended half wave resonator and a resonator provided with the multilayer thin-film electrode 10 on one of the end faces would serve as a quarter wave resonator. The outer surfaces of the dielectric member 1 and the inner surfaces of the hole 5 are herein referred to as a "D (Displacement) area," and the end faces of the dielectric member 1 on which the multilayer thin-film electrode 10 is formed are herein referred to as an "S (Short or Steady) area." The multilayer thin-film electrode 10 is formed in the S area, while the single-layer conductive film 4 which is divided into two portions, i.e., equal to the number of conductive thin films (2*a* and 2*b* in this example) of the multilayer thin-film electrode 10, is formed in the D area, thus allowing in-phase currents having the same amplitude to flow to the first and second conductive thin films 2*a* and 2*b* in the S area in radial direction with respect to the axis of symmetry.

The operation of the multilayer thin-film electrode 10 and the low-loss effect thereof are now described with reference to FIGS. 11A to 15.

Figure 11A:
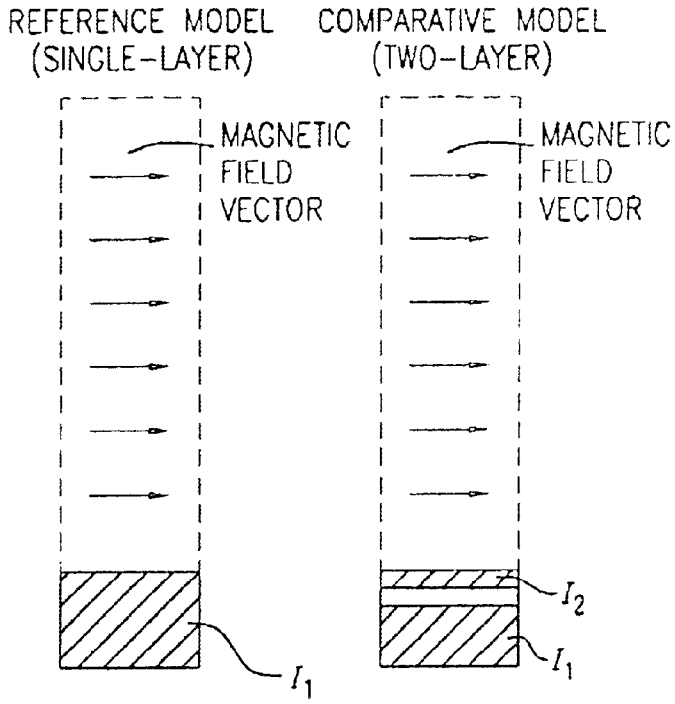
FIGS. 11A and 11B are views for illustrating the operation of a multilayer thin-film electrode with use of forced currents.
Figure 11B:
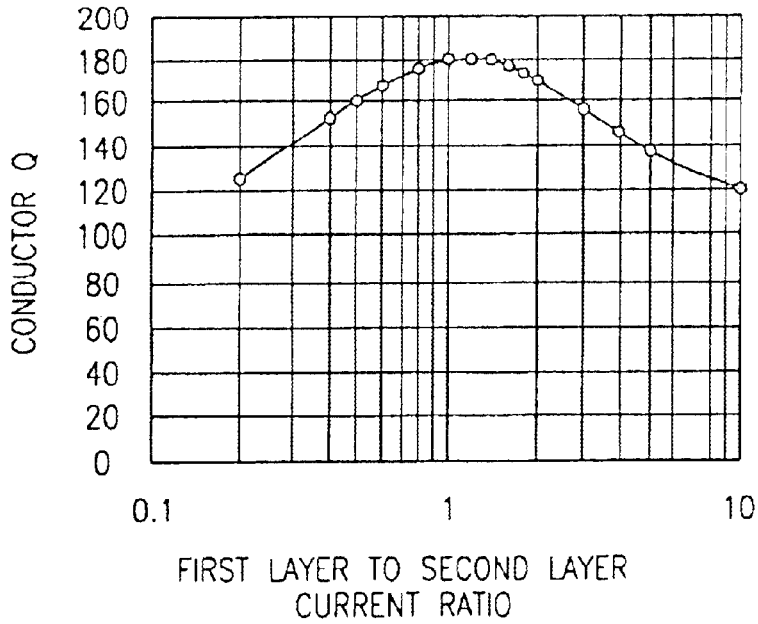

FIG. 11A shows a single-layer conductive film used as a reference model and a multilayer thin-film electrode, which has two-layer construction, used as a comparative model. FIG. 11B is a graph showing the ratio of current flow in a first conductive thin film to a second conductive thin film of the comparative multilayer thin-film electrode versus the conductor Q. This graph depicts analysis of conductor loss caused by a forced current in a parallel plate line having upper and lower electric walls and left and right magnetic walls. This analysis is performed using a method in which no displacement current is assumed, but only eddy currents are taken into account. This method is useful for analysis of a portion where an electric field does not have a vertical component on an interface of a conductive film. As shown in FIG. 11B, the analysis shows that the conductor Q increases by a factor of up to 1.51 when a current forces the first and second conductive thin films to be excited at an amplitude ratio of 1:1.

Figure 12A:
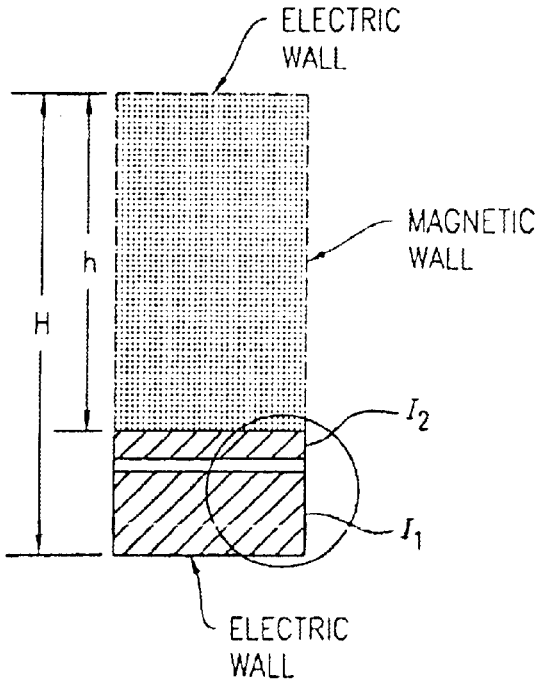
FIGS. 12A and 12B are diagrams of an analytic model of the multilayer thin-film electrode shown in FIG. 11A.
Figure 12B:
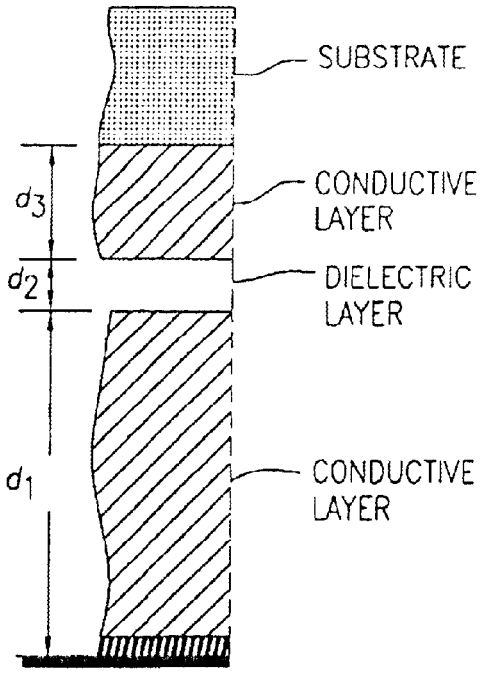

FIGS. 12A and 12B show an analytic model of the comparative multilayer thin-film electrode shown in FIG. 11A. In FIGS. 12A and 12B, this electrode is regarded as a parallel plate waveguide.

Figure 13A:
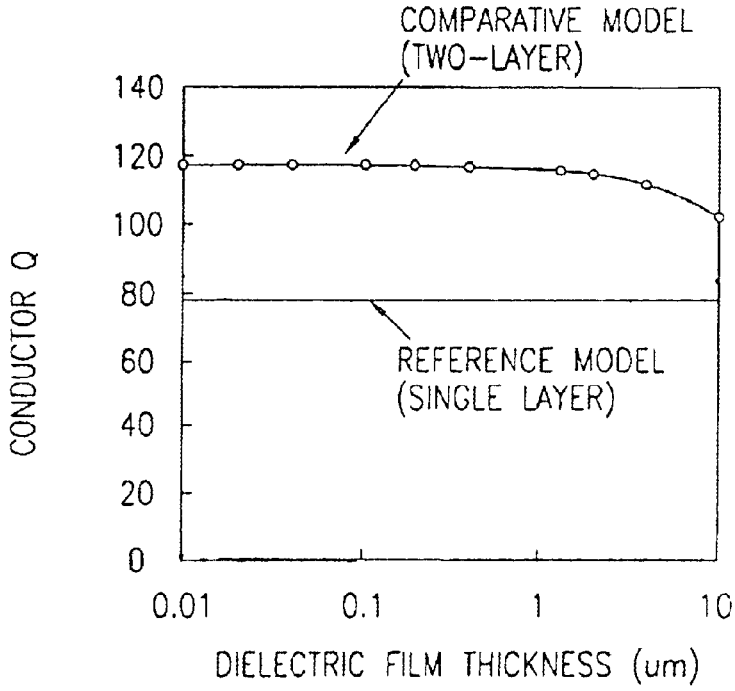
FIGS. 13A and 13B are graphs showing analysis of the dependency upon the dielectric film thickness in the multilayer thin-film electrode.
Figure 13B:
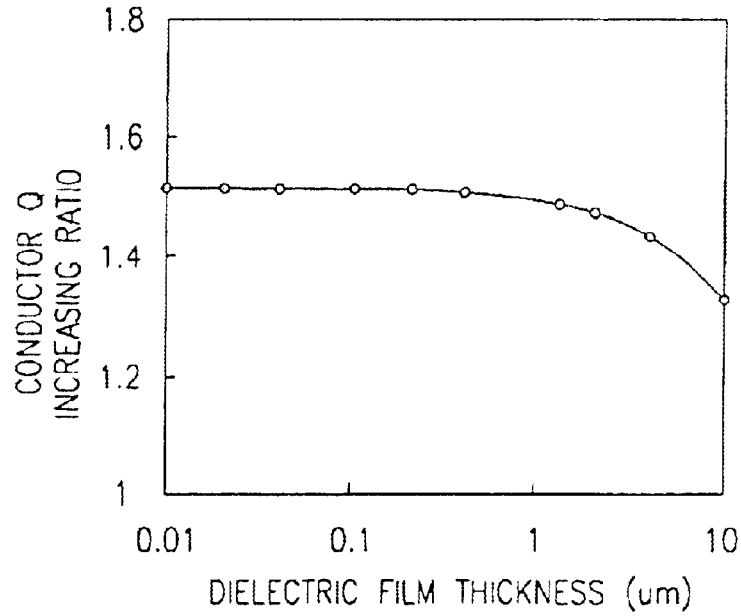

FIGS. 13A and 13B are graphs showing analysis of the dependency of the conductor Q upon the dielectric thin film thickness when the parameters shown in FIGS. 12A and 12B are set as follows:

| <reference model> | <comparative model> |
|---|---|
| | dimension: |
| $d_1 = 10\ \mu m$ | $d_1 = 10\ \mu m$ |
| $h = 60\ \mu m$ | $d_2$ = variab1e |
| $H = h + d_1 = 70\ \mu m$ | $d_3 = 1.26\ \mu m$ |
| | $h = 60\ \mu m - (d_2 + d_3)$ |
| | $(H = h + d_1 + d_2 + d_3 = 70\ \mu m)$ |
| | current: |
| $I_1 = 1$ A | $I_1 = 0.5$ A |
| | $I_2 = 0.5$ A |

An analytic solution $Q_c$ of the conductor Q of the reference single-layer conductive film is determined as follows:

$$Q_c=(2h/\delta)=(2\times 60\ \mu m)/1.55\ \mu m=77.4$$

FIG. 13A shows the conductor Q expressed as an absolute magnitude, and FIG. 13B shows the normalized version of the comparative model with respect to the reference model. As shown, when the thickness $d_2$ of the dielectric thin film in the comparative model changes, the conductor Q varies moderately, and a conductor-Q increasing factor of one or more is exhibited. When the thickness $d_2$ of the dielectric thin film is about 10 $\mu$m, the conductor Q is reduced because the proportion of the thickness $d_2$ of the dielectric thin film to the thickness of the substrate in the reference model increases.

Figure 14A:
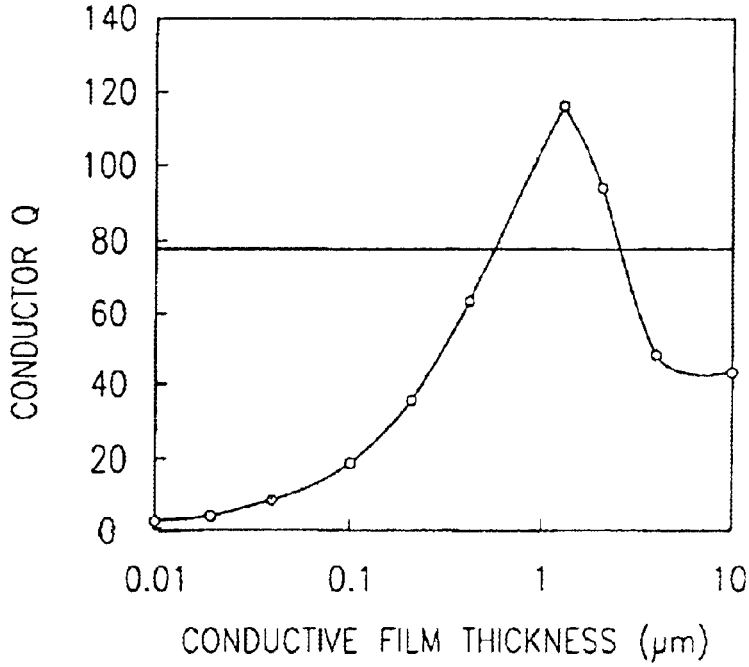
FIGS. 14A and 14B are graphs showing analysis of the dependency upon the conductive film thickness in the multilayer thin-film electrode.
Figure 14B:
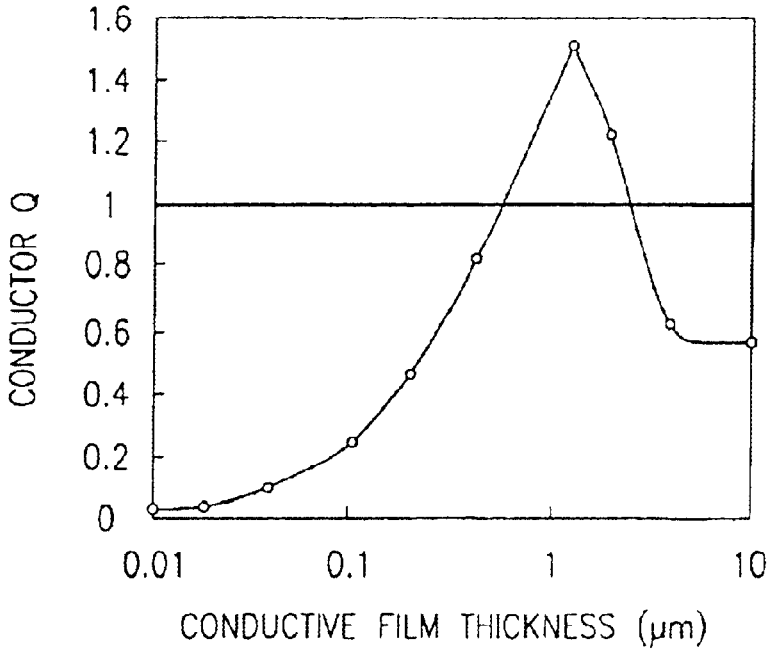
Figure 17A:
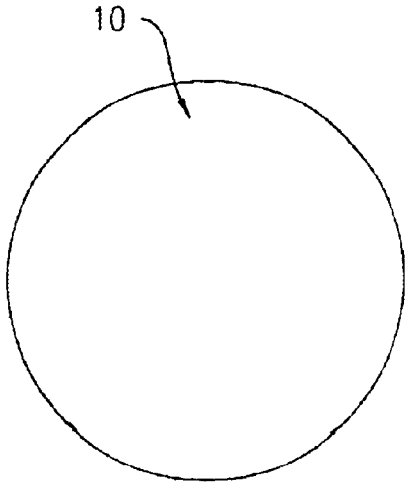
FIGS. 17A to 17C are views of a resonator in the related art.
Figure 17B:
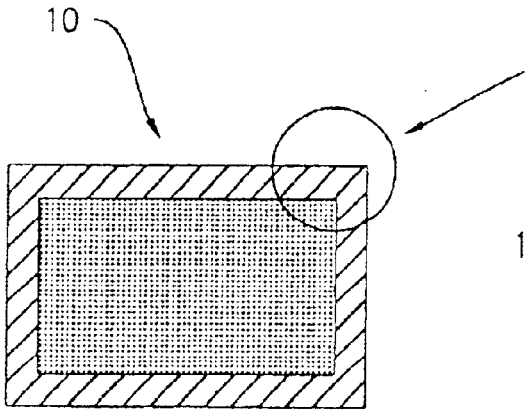
Figure 17C:
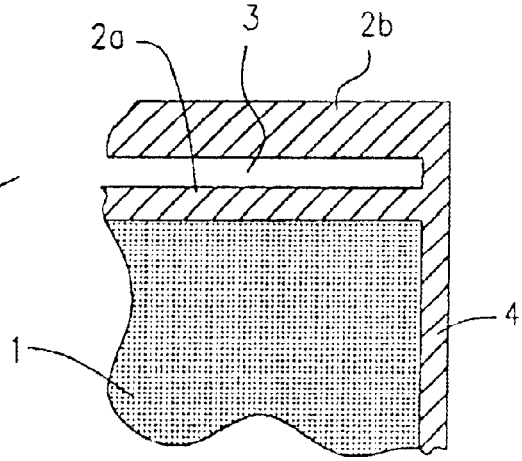
(PRIOR ART) FIG. 17C

FIGS. 14A and 14B are graphs showing the results of analysis of the dependency of the multilayer thin-film electrode upon the conductive thin film thickness. FIG. 14A shows the conductor Q versus the thickness of the conductive thin film; and FIG. 14B shows the normalized version of FIG. 14A with respect to the reference model.

When the thickness $d_3$ of the conductive thin film in the comparative model changes, the conductor Q exhibits a sharp peak, and a conductor-Q increasing factor of one or more is exhibited. When the thickness $d_3$ of the conductive thin film is about 10 $\mu$m, the conductor Q is reduced. The reason for this reduction is thought to be that, when the first conductive film (a film having the thickness $d_3$) on the interface side in the comparative model has a thickness of about 10 $\mu$m, reverse currents flow in opposing sides of the first conductive film, thus increasing the conductor loss. The thicknesses of the conductive thin films should be designed so that an area having a high conductor Q can be used.

FIG. 15 is a graph showing the relationship between the normalized value (normalized conductive film thickness) obtained by dividing the distance x from the conductor surface by skin depth δ, and a normalized value obtained by dividing the surface resistance R of a conductive film by the surface resistance $R_s$ of a bulk conductor.

The relationship shown in FIG. 15 is determined as follows:

First, an incidence matrix (F-matrix) for a plane wave propagating in a conductor is expressed by Equation (3):

$$F = \begin{pmatrix} \cosh\gamma x & Z_s \sinh\gamma x \\ \frac{1}{Z_s}\sinh\gamma x & \cosh\gamma x \end{pmatrix} \tag{3}$$

where x denotes the distance from the conductor surface, γ denotes a propagation coefficient, and $Z_s$ denotes the characteristic impedance. The propagation coefficient γ is determined as follows:

$$\gamma = \frac{1+j}{\delta} \tag{4}$$

The characteristic impedance $Z_s$ is determined as follows:

$$Z_s = (1+j)\cdot R_s \tag{5}$$

where δ denotes the skin depth of a bulk conductor, and $R_s$ denotes the surface resistance of the bulk conductor.

The surface impedance of a conductive thin film having thickness x is calculated by the following equation using the ratio of the 11 component to the 21 component of the F-matrix on condition that the back surface is open:

$$Z = Z_s \cdot \frac{\cosh\gamma x}{\sinh\gamma x} \tag{6}$$

Substituting Equations (4) and (5) into Equation (6) and organizing the resulting equation in terms of the real part and the imaginary part yield Equation (7):

$$Z = R_s \cdot \frac{\sinh\left(\frac{x}{\delta}\right)\cdot\cosh\left(\frac{x}{\delta}\right) + \sin\left(\frac{x}{\delta}\right)\cdot\cos\left(\frac{x}{\delta}\right)}{\cosh^2\left(\frac{x}{\delta}\right) - \cos^2\left(\frac{x}{\delta}\right)} + jR_s \cdot \frac{\sinh\left(\frac{x}{\delta}\right)\cdot\cosh\left(\frac{x}{\delta}\right) - \sin\left(\frac{x}{\delta}\right)\cdot\cos\left(\frac{x}{\delta}\right)}{\cosh^2\left(\frac{x}{\delta}\right) - \cos^2\left(\frac{x}{\delta}\right)} \tag{7}$$

The surface resistance is determined from the real part (the imaginary part indicates the surface reactance) as follows:

$$R = R_s \cdot \frac{\sinh\left(\frac{x}{\delta}\right)\cdot\cosh\left(\frac{x}{\delta}\right) + \sin\left(\frac{x}{\delta}\right)\cdot\cos\left(\frac{x}{\delta}\right)}{\cosh^2\left(\frac{x}{\delta}\right) - \cos^2\left(\frac{x}{\delta}\right)} \tag{8}$$

FIG. 15 shows Equation (8).

A region shown in FIG. 15 which has an $R/R_s$ ratio of one or lower is an area having a smaller surface resistance than that of the bulk conductor. In other words, a multilayer thin-film structure formed on an area having a range of about 1.1417 to 2.7505 times the skin depth achieves an effect of improving the conductor Q. If the thickness x is reduced, the lower limit (1.1417 in FIG. 15) of the normalized conductive film thickness when the $R/R_s$ ratio is one or more is reduced as the number of layered films increases. The value of x/δ (1.5708 in FIG. 15) when the $R/R_s$ ratio is minimized also varies depending upon the number of layered films. The upper limit (2.7505 in FIG. 15) of the normalized conductive film thickness when the $R/R_s$ ratio is one or more is constant regardless of the number of layered films. Therefore, the thickness x of the conductive thin film should be selected, depending upon the number of layered films, from a range of values when the value of x/δ is about 2.75 or more.

Although the multilayer thin-film electrode 10 on the side surface has a two-layer construction in FIGS. 1A to 3C, the present invention is not limited to this form. A multilayer thin-film electrode having three or more conductive thin films may be used, in which case lower-loss operation can be achieved.

For example, an electrode having four conductive thin films may also use a dielectric member having an octagonal cylinder, such that the conductive thin films are electrically connected with four pairs of single-layer conductive films, each pair being formed on two parallel facing sides.

According to the first embodiment, thereof, in an electrode having three or more conductive thin films, currents having equal amplitudes flow in the conductive thin films, thereby making it possible to maximize the Q factor of the multilayer thin-film electrode.

A resonator according to a second embodiment of the present invention is now described with reference to FIGS. 4A to 4D.

Figure 4A:
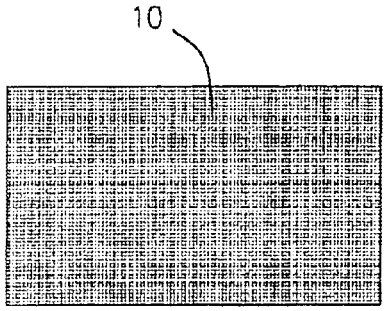
FIGS. 4A to 4D are views of a resonator according to a second embodiment of the present invention.
Figure 4B:
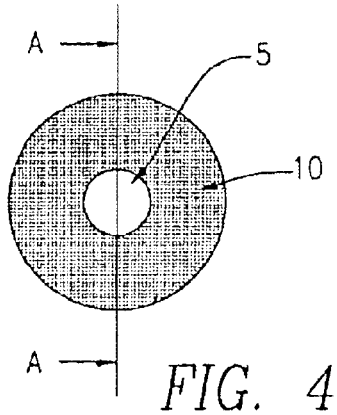
Figure 4C:
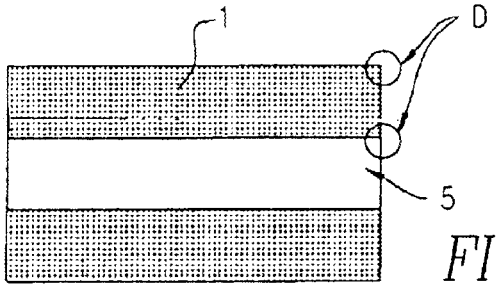
Figure 4D:
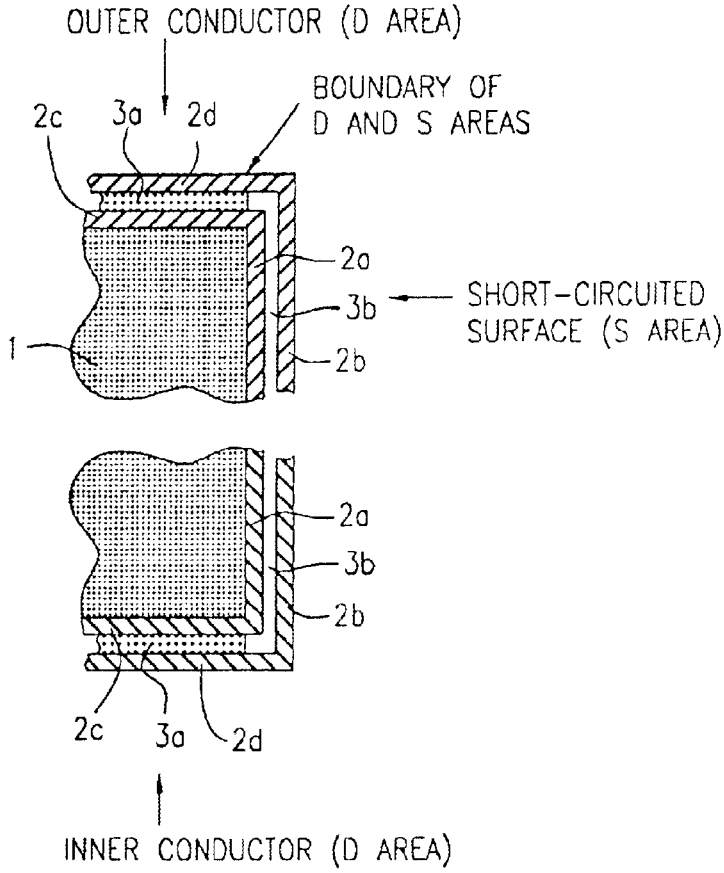

The resonator according to the second embodiment is a coaxial resonator having a tubular dielectric member. FIGS. 4A and 4B are a front view and a right side view of the resonator, respectively; FIG. 4C is a cross-sectional view of the resonator, taken along a line A—A of FIG. 4B; and FIG. 4D is a cross-sectional view of the enlarged version of part D of the resonator shown in FIG. 4C. A multilayer thin-film electrode constructed by laminating a conductive thin film 2*c*, a dielectric thin film 3*a*, and a conductive thin film 2*d* is formed on the outer surface of the tubular dielectric member 1 and the inner surface of a hole 5. A multilayer thin-film electrode is constructed by laminating a conductive thin film 2*a*, a dielectric thin film 3*b*, and a conductive thin film 2*b* on each of the two parallel end faces of the dielectric member 1.

The multilayer thin-film electrode formed in the D area, i.e., on each of the outer surfaces of the dielectric member 1 and the inner surface of the hole 5, is electrically connected to the multilayer thin-film electrode formed in the S area, i.e., on each of the parallel end faces of the dielectric member 1, through their corresponding conductive thin films. Specifically, the conductive thin films 2*a* and 2*c* are connected to each other, and the conductive thin films 2*b* and 2*d* are connected to each other.

In this structure, a resonator provided with the multilayer thin-film electrode on each of the two parallel end faces of the dielectric member 1 would serve as a short-ended half wave resonator; and a resonator provided with the multilayer thin-film electrode on one of the end faces would serve as a quarter wave resonator.

A TEM-mode electric field component vertically enters the multilayer thin-film electrode in the D area, thus causing an electric field to be generated in the dielectric thin film thereof in the thickness direction thereof. This is a displacement current in the dielectric thin film, into which actual currents flowing in the conductive thin films 2*c* and 2*d* are transformed. The thicknesses of the conductive thin films 2*c* and 2*d* and the dielectric thin film 3*a* of the multilayer thin-film electrode in the D area are determined according to a film-thickness design of the multilayer thin-film electrode. Specifically, the thicknesses of the conductive thin films 2*c* and 2*d* are designed based on the skin depth and the number of layered conductive films. The thickness of the dielectric thin film 3*a* is determined based on the ratio of dielectric constant of the base dielectric member 1 to the dielectric constant of the dielectric thin film 3*a*, and the number of layered dielectric films.

In the dielectric thin film 3*b* of the multilayer thin-film electrode in the S area, no electric field is generated in the thickness direction thereof, resulting in no displacement current. The distribution ratio in amplitude and phase of the actual currents in the conductive thin films 2*a* and 2*b* is thus reserved. Therefore, the actual currents in the conductive thin films 2*c* and 2*d* can be substantially uniformly distributed in both amplitude and phase. This enables low-loss operation in the multilayer thin-film electrode in the S area, as described above.

As described with reference to FIGS. 13A and 13B, the dielectric thin film 3*b* of the multilayer thin-film electrode in the S area does not exhibit a sharp peak in a graph of conductor Q versus dielectric thin film thickness. That is, the thickness of the dielectric thin film 3*b* of the multilayer thin-film electrode in the S area does not have a center design value. Therefore, the dielectric thin film 3*b* should be designed to be insulating and to be as thin as possible.

A resonator according to a third embodiment of the present invention is now described with reference to FIGS. 5A to 6D.

Figure 5A:
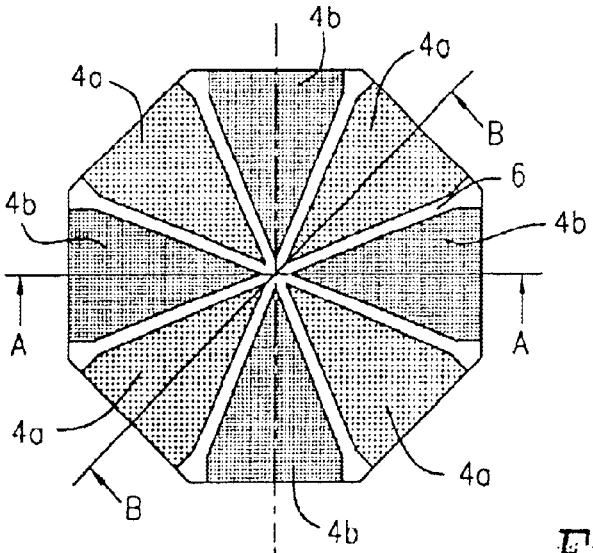
FIGS. 5A to 5C are views of a resonator according to a third embodiment of the present invention.
Figure 5B:
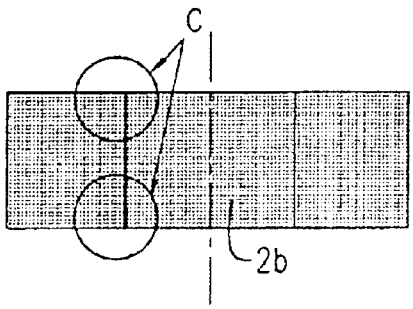
Figure 5C:
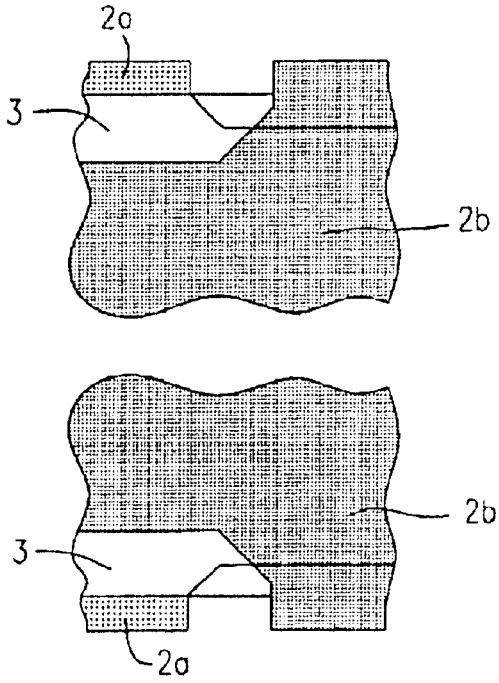
Figure 6A:
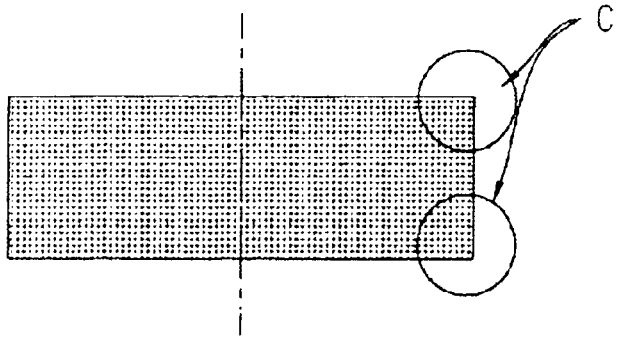
FIGS. 6A and 6B are cross-sectional views of the resonator, taken along lines A—A and B—B of FIG. 5A, respectively.
Figure 6C:
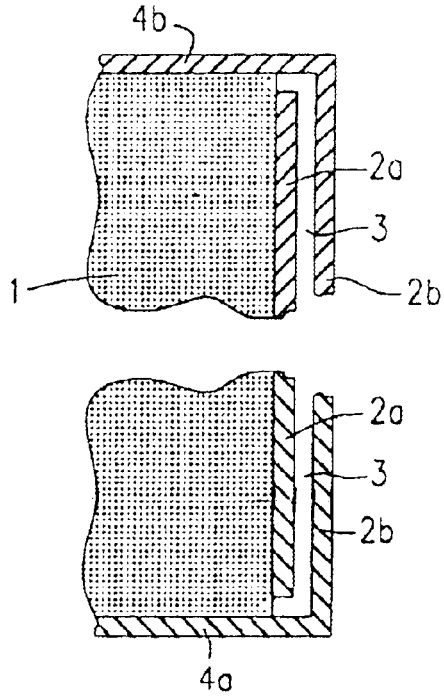
FIGS. 6C and 6D are cross-sectional views of the enlarged version of part C and D shown in FIGS. 6A and 6B, respectively.
Figure 6B:
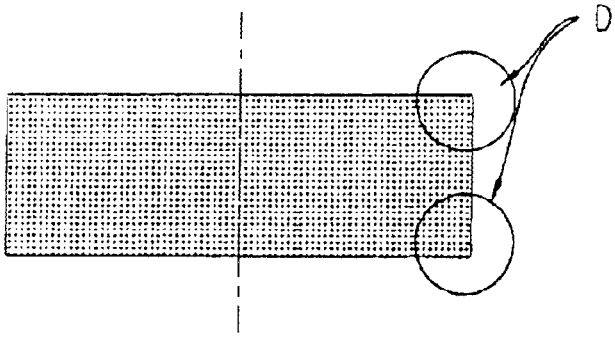
Figure 6D:
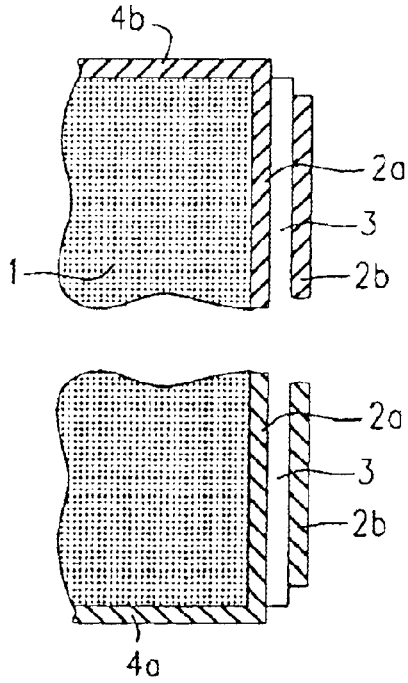

FIGS. 5A and 5B are a top plan view and a front view of the resonator, and FIG. 5C is an enlarged view of part C of the resonator shown in FIG. 5B. FIGS. 6A and 6B are cross-sectional views of the resonator, taken along lines A—A and B—B of FIG. 5A, respectively. FIGS. 6C and 6D are cross-sectional views of the enlarged version of part C and D shown in FIGS. 6A and 6B, respectively.

The resonator according to the third embodiment uses a dielectric member 1 having an octagonal cylindrical shape, and a multilayer thin-film electrode formed of a conductive thin film 2*a*, a dielectric thin film 3, and a conductive thin film 2*b* is formed on each of the eight side surfaces of the dielectric member 1. A single-layer conductive film that is divided into eight portions 4*a* and 4*b* by slits 6 interposed between the film portions 4*a* and 4*b* is formed on each of the upper and lower parallel surfaces of the dielectric member 1. The conductive thin films 2*a* of the multilayer thin-film electrodes on the side surfaces of the dielectric member 1 are connected to the single-layer conductive film portions 4*a* formed on the upper and lower surfaces. The conductive thin films 2*b* of the multilayer thin-film electrodes are connected to the single-layer conductive film portions 4*b* formed on the upper and lower surfaces.

The resonator according to the third embodiment serves as a short-circuited TM-mode (axially symmetric mode) resonator. An axially symmetric mode allows a current to be uniformly distributed over the eight single-layer conductive film portions 4*a* and 4*b* which are separated by the slits 6. When a current outwardly flows onto the upper surface of the dielectric member 1, a current inwardly flows onto the lower surface of the dielectric member 1. As a result, the conductive thin films 2*a* and 2*b* of the multilayer thin-film electrodes on the side surfaces are forcibly excited with substantially in-phase currents having substantially equal amplitude. Since the eight side surfaces of the dielectric member 1 are short-circuited, no electric field is generated in the dielectric thin films 3 on the side surfaces in the thickness thereof. That is, no displacement current occurs. The distribution ratio in amplitude and phase of the actual current in the conductive thin films 2*a* and 2*b* is thus reserved. As described above, since the thickness of the dielectric thin film 3 does not have a center design value, it is only required that the dielectric thin film 3 be insulating and that the dielectric thin film 3 be designed to be as thin as a predetermined insulating capability can be given.

Although the dielectric member 1 which has an octagonal cylindrical shape has been described with reference to FIGS. 5A to 5C, the shape of the dielectric member 1 is not limited to an octagonal cylindrical shape, and any shape may be used. In general, however, a polygonal shape having a larger number of sides is preferred because it can achieve more ideal current distribution in the multilayer thin-film electrode on the side surfaces of the dielectric member 1.

In FIGS. 5A to 5C, the multilayer thin-film electrode on the side surfaces of the dielectric member 1 has a two-layer construction. However, the present invention is not limited to this form, and a multilayer thin-film electrode having three or more conductive thin films may be used, in which case lower-loss operation can be achieved.

A resonator according to a fourth embodiment of the present invention is now described with reference to FIGS. 7A to 7D.

Figure 7A:
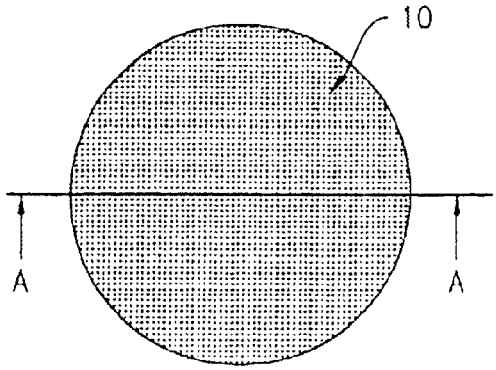
FIGS. 7A to 7D are views of a resonator according to a fourth embodiment of the present invention.
Figure 7B:
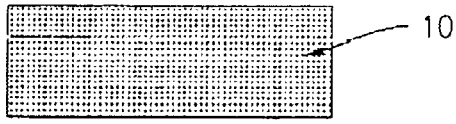
Figure 7C:
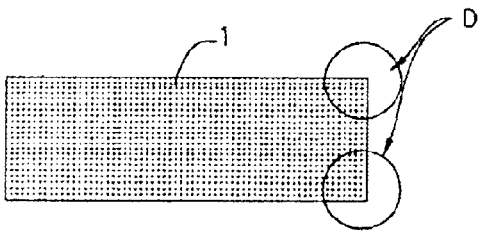
Figure 7D:
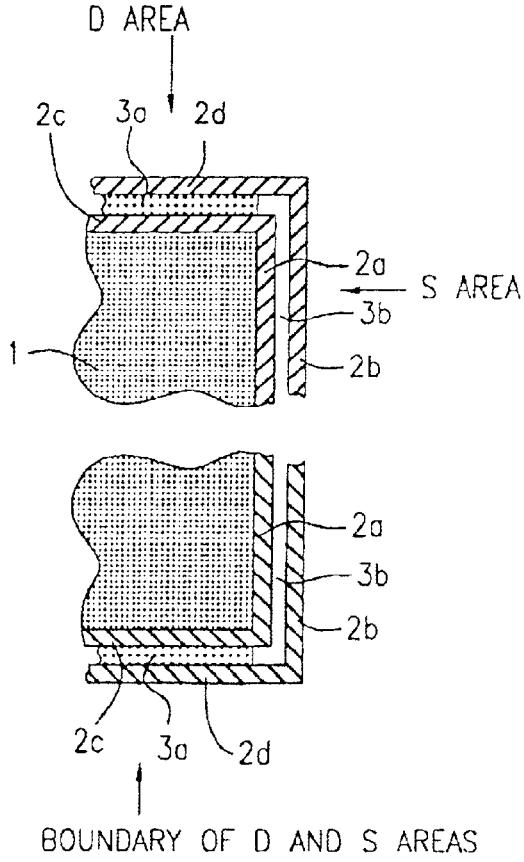

FIGS. 7A and 7B are a top plan view and a front view of the resonator; FIG. 7C is a cross-sectional view of the resonator, taken along a line A—A of FIG. 7A; and FIG. 7D is a cross-sectional view showing the enlarged version of part D shown in FIG. 7C. The resonator is provided with a multilayer thin-film electrode on each of the upper and lower surfaces and the side surfaces of a cylindrical dielectric member 1. The thicknesses of conductive thin films 2*c* and 2*d* and a dielectric thin film 3*a* of the multilayer thin-film electrode on each of the upper and lower surfaces are determined according to a multilayer thin-film electrode design. The thicknesses of conductive thin films 2*a* and 2*b* of the multilayer thin-film electrode on the side surfaces are determined according to a multilayer thin-film electrode design. The thickness of a dielectric thin film 3*b* of the multilayer thin-film electrode on the side surfaces is designed so as to be insulating and to be as thin as possible, as in the aforementioned embodiments. The conductive thin films 2*a* and 2*b* in the S area, i.e., on the side surfaces, are electrically connected with the conductive thin films 2*c* and 2*d* in the D area, i.e., on each of the upper and lower surfaces, at the boundaries thereof, respectively.

The resonator in FIGS. 7A to 7D serves as a short-circuited TM-mode (axially symmetric mode) resonator. Specifically, an electric field component vertically enters the multilayer thin-film electrode on each of the upper and lower surfaces, thus causing an electric field to be generated in the dielectric thin film 3*a* in the thickness direction thereof. This is a displacement current in the dielectric thin film 3*a*, into which actual currents flowing in the conductive thin films 2*c* and 2*d* are transformed. The thicknesses of the conductive thin films 2*c* and 2*d* and the dielectric thin film 3*a* of the multilayer thin-film electrode in the D area are determined according to a film-thickness design of the multilayer thin-film electrode. The thickness of the dielectric thin film 3*a* which is determined according to a multilayer thin-film design, thus allowing the actual currents in the conductive thin films 2*c* and 2*d* to be substantially uniformly distributed both in amplitude and phase. This causes the conductive thin films 2*a* and 2*b* in the S area to be forcibly excited with substantially in-phase and substantially equal current amplitude. Since the S area on the side surfaces are short-circuited, no electric field is generated in the dielectric thin film 3*b* of the multilayer thin-film electrode in the S area in the thickness direction thereof, resulting in no displacement current. The distribution ratio in amplitude and phase of currents in the conductive thin films 2*c* and 2*d* of the multilayer thin-film electrode in the D area is thus reserved for the conductive thin films 2*a* and 2*b* of the multilayer thin-film electrode in the S area.

Therefore, low-loss operation of the multilayer thin-film electrodes in the D and S areas can be achieved.

In the foregoing embodiments, conductive thin films and dielectric thin films are alternately layered to form a multilayer thin-film electrode. However, the multilayer thin-film electrode may be formed by any other technique such as by inserting several tens nanometers of thin-film material, such as titanium (Ti), between the conductive thin films and the dielectric thin films in order to improve the tightness between the conductive thin films and the dielectric thin films.

Figure 8:
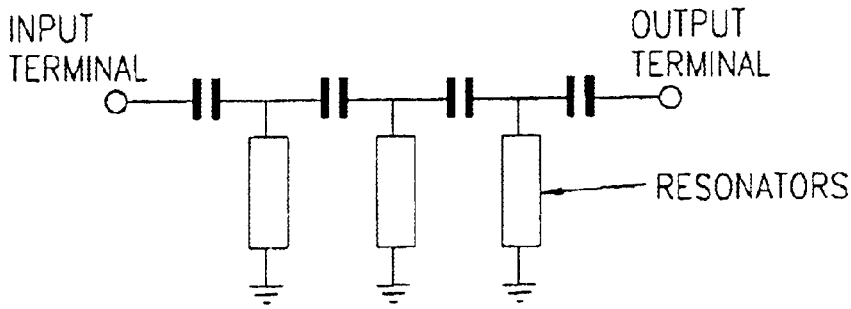
FIG. 8 is an equivalent circuit diagram of a filter according to a fifth embodiment of the present invention.

A filter according to a fifth embodiment of the present invention is now described with reference to FIG. 8. In FIG. 8, three resonators are implemented by any of the resonators according to the first to fourth embodiments. The resonators are capacitively coupled to each other, as shown by capacitors in FIG. 8, and the first resonator and the last resonator are capacitively coupled to input and output terminals, respectively, thereby achieving a three-resonator filter having a band-pass filtering characteristic.

A duplexer according to a sixth embodiment of the present invention is now described with reference to FIG. 9.

A transmission filter and a reception filter are implemented by the filter shown in FIG. 8, etc. The filtering characteristics of the transmission filter and the reception filter should be determined so that the transmission filter allows a component to pass the transmission band and the reception filter allows a component to pass the reception band.

A phase control is performed between the output port of the transmission filter and the input port of the reception filter in order to prevent a transmission signal from being passed towards the reception filter and a received signal from being passed towards the transmission filter.

Figure 10:
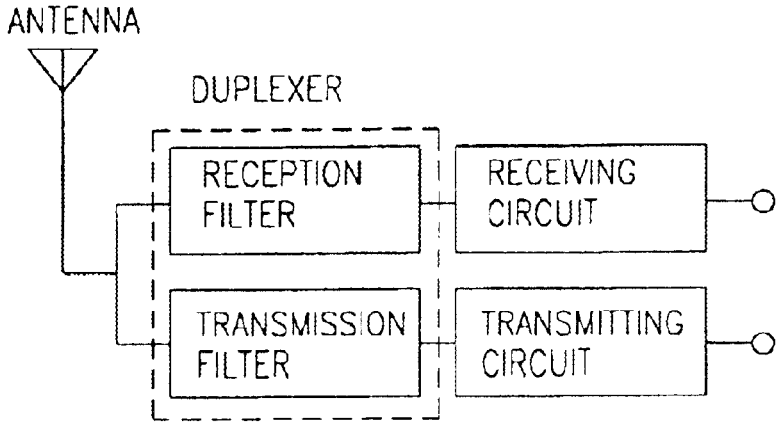
FIG. 10 is a block diagram of a communication apparatus according to a seventh embodiment of the present invention.

A communication apparatus according to a seventh embodiment of the present invention is now described with reference to FIG. 10.

Figure 9:
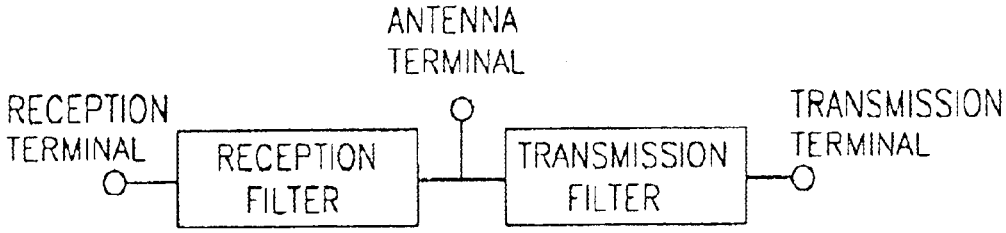
FIG. 9 is a block diagram of a duplexer according to a sixth embodiment of the present invention.

A duplexer is implemented as the duplexer shown in FIG. 9. The transmission terminal and reception terminal of the duplexer are connected to a transmitting circuit and a receiving circuit, respectively. The antenna terminal is connected to an antenna.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A resonator comprising:

a dielectric member; and an electrode formed on the dielectric member, the electrode having:

a first multilayer thin-film portion formed from alternately layered conductive thin films and a dielectric thin film, the first multilayer thin-film portion having a displacement area provided in a first interface between the dielectric member and the electrode in which a first electric field has a higher vertical component than a predetermined threshold, and a second multilayer thin-film portion formed from the same number of layered films as the first multilayer thin-film portion, the second multilayer thin-film portion having a steady area provided in a second interface between the dielectric member and the electrode in which a second electric field has a lower vertical component than the predetermined threshold, wherein the corresponding conductive thin films of the first multilayer thin-film portion and the second multilayer thin-film portion are electrically connected to each other.

2. A resonator comprising:

a dielectric member; and an electrode formed on the dielectric member, the electrode having:

a first portion formed from a plurality of electrode patterns, the first portion defining a displacement area in a first interface between the dielectric member and the electrode in which a first electric field has a higher vertical component than a predetermined threshold so that a displacement current flow is substantially uniform over the first interface, and a second portion formed from alternately layered conductive thin films and a dielectric thin film, the second portion having a steady area provided in a second interface between the dielectric member and the electrode in which a second electric field has a lower vertical component than the predetermined threshold, wherein the plurality of electrode patterns of the first portion and the conductive thin films of the second portion are respectively connected to each other.

3. A resonator comprising:

a dielectric member; and an electrode formed on the dielectric member, the electrode having:

a first portion formed from alternately layered conductive thin films and a dielectric thin film, the first portion having a steady area provided in a first interface between the dielectric member and the electrode in which a first electric field has a lower vertical component than a predetermined threshold, and a second portion formed from an electrode pattern which is divided into substantially congruent electrode patterns of an integer multiple of the number of conductive thin films of the first portion, the second portion defining a displacement area in a second interface between the dielectric member and the electrode in which a second electric field has a higher vertical component than the predetermined threshold, wherein the electrode patterns of the second portion and the conductive thin films of the first portion are respectively connected to each other.

4. The resonator according to claim 1, wherein the dielectric member includes one of a plurality of curves and a plurality of flat surfaces, and a plurality of flat surfaces, and wherein the displacement area and the steady area are defined in each of the surfaces of the dielectric member.

5. The resonator according to claim 1, wherein the thickness of at least one of the conductive thin films is 2.75 times a skin depth or lower.

6. A filter comprising:

the resonator according to claim 1; and signal input and output units connected to the resonator.

7. A duplexer comprising two of the filters according to claim 6, wherein the signal input and output units include a transmission-signal input terminal, a shared transmission and reception input and output terminal, and a received-signal output terminal.

8. A high-frequency circuit apparatus comprising the resonator according to claim 1.

9. The resonator according to claim 2, wherein the dielectric member includes one of a plurality of curves and a plurality of flat surfaces, and a plurality of flat surfaces, and wherein the displacement area and the steady area are defined in each of the surfaces of the dielectric member.

10. The resonator according to claim 3, wherein the dielectric member includes one of a plurality of curves and a plurality of flat surfaces, and a plurality of flat surfaces, and wherein the displacement area and the steady area are defined in each of the surfaces of the dielectric member.

11. The resonator according to claim 2, wherein the thickness of at least one of the conductive thin films is 2.75 times a skin depth or lower.

12. The resonator according to claim 3, wherein the thickness of at least one of the conductive thin films is 2.75 times a skin depth or lower.

13. A filter comprising:

the resonator according to claim 2; and signal input and output units connected to the resonator.

14. A duplexer comprising two of the filters according to claim 13, wherein the signal input and output units include a transmission-signal input terminal, a shared transmission and reception input and output terminal, and a received-signal output terminal.

15. A filter comprising:

the resonator according to claim 3; and signal input and output units connected to the resonator.

16. A duplexer comprising two of the filters according to claim 15, wherein the signal input and output units include a transmission-signal input terminal, a shared transmission and reception input and output terminal, and a received-signal output terminal.

17. A high-frequency circuit apparatus comprising the resonator according to claim 2.

18. A high-frequency circuit apparatus comprising the resonator according to claim 3.

* * * * *